US009227101B2

(12) United States Patent
Maguire

(10) Patent No.: US 9,227,101 B2
(45) Date of Patent: Jan. 5, 2016

(54) ENDLESS BELT MULTI-FUNCTION TRAINING SYSTEM

(76) Inventor: Anthony Maguire, County Meath (IE)

( * ) Notice: Subject to any disclaimer, the term of this patent is extended or adjusted under 35 U.S.C. 154(b) by 553 days.

(21) Appl. No.: 13/350,362

(22) Filed: Jan. 13, 2012

(65) Prior Publication Data

US 2013/0184125 A1 Jul. 18, 2013

(51) Int. Cl.

| | |
|---|---|
| ***A63B 22/02*** | (2006.01) |
| ***A63B 21/02*** | (2006.01) |
| ***A63B 21/00*** | (2006.01) |
| ***A63B 21/22*** | (2006.01) |

(52) U.S. Cl.

CPC ..... *A63B 22/02* (2013.01); *A63B 21/00069* (2013.01); *A63B 21/028* (2013.01); *A63B 21/1469* (2013.01); *A63B 21/225* (2013.01)

(58) Field of Classification Search

CPC ..... A63B 22/02; A63B 21/225; A63B 2022/0214

See application file for complete search history.

(56) References Cited

U.S. PATENT DOCUMENTS

| | | | | | |
|---|---|---|---|---|---|
| 931,394 | A * | 8/1909 | Day | 482/54 |
| 5,031,901 | A * | 7/1991 | Saarinen | 482/63 |
| 5,180,348 | A * | 1/1993 | Saarinen | 482/6 |
| 5,254,064 | A * | 10/1993 | Rock | 482/126 |
| 5,411,455 | A | 5/1995 | Haber et al. | |
| 5,665,032 | A | 9/1997 | Chen | |
| 5,871,421 | A | 2/1999 | Trulaske et al. | |
| 5,897,460 | A * | 4/1999 | McBride et al. | 482/54 |
| 6,575,876 | B1 * | 6/2003 | Phelps-McMillon | 482/51 |
| 6,676,569 | B1 * | 1/2004 | Radow | 482/4 |
| 6,893,382 | B1 | 5/2005 | Moon et al. | |
| 7,014,600 | B2 * | 3/2006 | Johnson | 482/140 |
| 7,066,865 | B2 * | 6/2006 | Radow | 482/4 |
| 7,147,591 | B2 * | 12/2006 | McAvoy | 482/91 |
| 7,494,450 | B2 * | 2/2009 | Solomon | 482/69 |
| 7,608,015 | B2 * | 10/2009 | Radow | 482/4 |
| 7,766,801 | B2 * | 8/2010 | Campanaro et al. | 482/96 |
| 7,887,466 | B1 * | 2/2011 | Chen | 482/54 |
| 7,985,166 | B2 * | 7/2011 | Farnsworth et al. | 482/54 |
| 8,100,815 | B2 * | 1/2012 | Balaker et al. | 482/70 |
| 8,147,386 | B2 * | 4/2012 | Farnsworth et al. | 482/54 |
| 8,215,325 | B2 * | 7/2012 | Montanti | 135/66 |
| 2006/0040799 | A1 * | 2/2006 | Pompile | 482/92 |
| 2011/0015039 | A1 | 1/2011 | Shea | |
| 2011/0034303 | A1 | 2/2011 | Crawford et al. | |
| 2011/0082011 | A1 | 4/2011 | Ellis | |
| 2011/0082013 | A1 * | 4/2011 | Bastian | 482/54 |

* cited by examiner

*Primary Examiner* — Stephen Crow

(74) *Attorney, Agent, or Firm* — Stephen H. Eland; Dann, Dorfman, Herrell & Skillman

(57) ABSTRACT

A training apparatus having an endless belt is provided. The apparatus provides a treadmill operable to simulate a variety of high intensity exercises. In particular, the apparatus is designed to simulate high intensity pushing and pulling exercises. The system includes forward and rearward mounts for attaching accessories to facilitate various training exercises. The system also includes a drive control with multiple flywheels for providing variable resistance to rotation of the treadmill.

36 Claims, 9 Drawing Sheets

ENDLESS BELT MULTI-FUNCTION TRAINING SYSTEM

FIELD OF THE INVENTION

The present invention relates to the field of exercise equipment and more specifically to multiple function training equipment that incorporates an endless belt, such as a treadmill.

BACKGROUND

A variety of systems have been used over the years to provide aerobic exercise. For instance, treadmills have long been used to provide a way for individuals to run or walk at various paces to suit the user. Such treadmills typically have a motor that drives the belt, so that the belt rotates whether the user is on the treadmill or not.

Although treadmills may provides an aerobic workout, they have limited usefulness in various high intensity cross-training exercises and exercises that simulate exercises that traditionally require outdoor equipment and/or a significant amount of space. For instance, in several sports such as American football and rugby, common work-out routines include high-intensity pushing and pulling exercises. For instance, in American football, athletes commonly workout by driving a blocking sled or pulling a weight or weighted sled. Such exercises require a significant amount of space to perform. Attempts to simulate such exercises on indoor exercise equipment have failed for many reasons. For instance, the known systems have been unable to replicate the intensity required to start driving the known weighted driving systems and to continue to drive the system.

Accordingly, there is a need for a system that allows the user to replicate various high intensity aerobic and anaerobic exercises, such as pushing, pulling exercises as well as other exercises commonly done by athletes involved in sports that include blocking and/or driving an opponent, such as in American football and rugby.

SUMMARY OF THE INVENTION

In light of the foregoing, a system is provided that comprises a non-motorized treadmill entrained about a pair of drive rotary elements, such as wheels or rollers. A drive control system controls the operation of the treadmill. The drive control system includes a plurality of flywheel interconnected with one of the drive wheels. A first flywheel connected with the roller increases the inertial of the system to thereby increase the force required by the user to get the belt moving. A second flywheel is connected with the first flywheel and may be connected so that the second flywheel rotates at a different speed that the first flywheel. Additionally, the second flywheel may be configured so that the rotational moment of inertia of the second flywheel is different from the rotational moment of inertia of the first flywheel.

In accordance with another aspect of the invention, the system may include a third flywheel rotationally connected with the first or second fly wheel. The third flywheel may be connected with the first or second flywheel so that the third flywheel rotates at a different rate than the first or second flywheel or both. The third flywheel may also have a rotational moment of inertia that is different from the first or second flywheels or both.

In accordance with another aspect of the invention, the system may include an element for applying variable resistance to one or more of the flywheels.

In accordance with another aspect of the invention, the system includes a treadmill having a belt entrained about a pair of rotary elements. The system includes a frame supporting the treadmill and a pair of arms laterally spaced apart from one another. The arms project upwardly from the frame and forwardly from the forward end of the belt. A track is provided on each arms for allowing accessories to be variably positioned along the length of the arm. In one embodiment, the accessory may be a hand hold mounted onto a base. The base is slideable in the track to vary the vertical positioning of the hand hold that the user grasps during use. Additionally, sliding the base in the track varies the horizontal position of the hand hold relative to the forward end of the belt. The system may also include a locking element for locking the base in place in the track after being positioned.

In accordance with another aspect of the invention, a system is provided that includes an endless belt entrained about two rotatable elements. The system includes a frame projecting rearwardly from the rearward end of the belt. The frame includes a generally vertical post projecting upwardly above the height of the belt. The vertical post provides a connector for variably positioning an accessory along the height of the vertical post. In one embodiment, the connector is cooperable with a second connector attached to an elongated strap the the user can engage to simulate various pulling exercises.

DESCRIPTION OF THE DRAWINGS

The foregoing summary and the following detailed description of the preferred embodiments of the present invention will be best understood when read in conjunction with the appended drawings, in which.

DETAILED DESCRIPTION OF THE INVENTION

Figure 1:
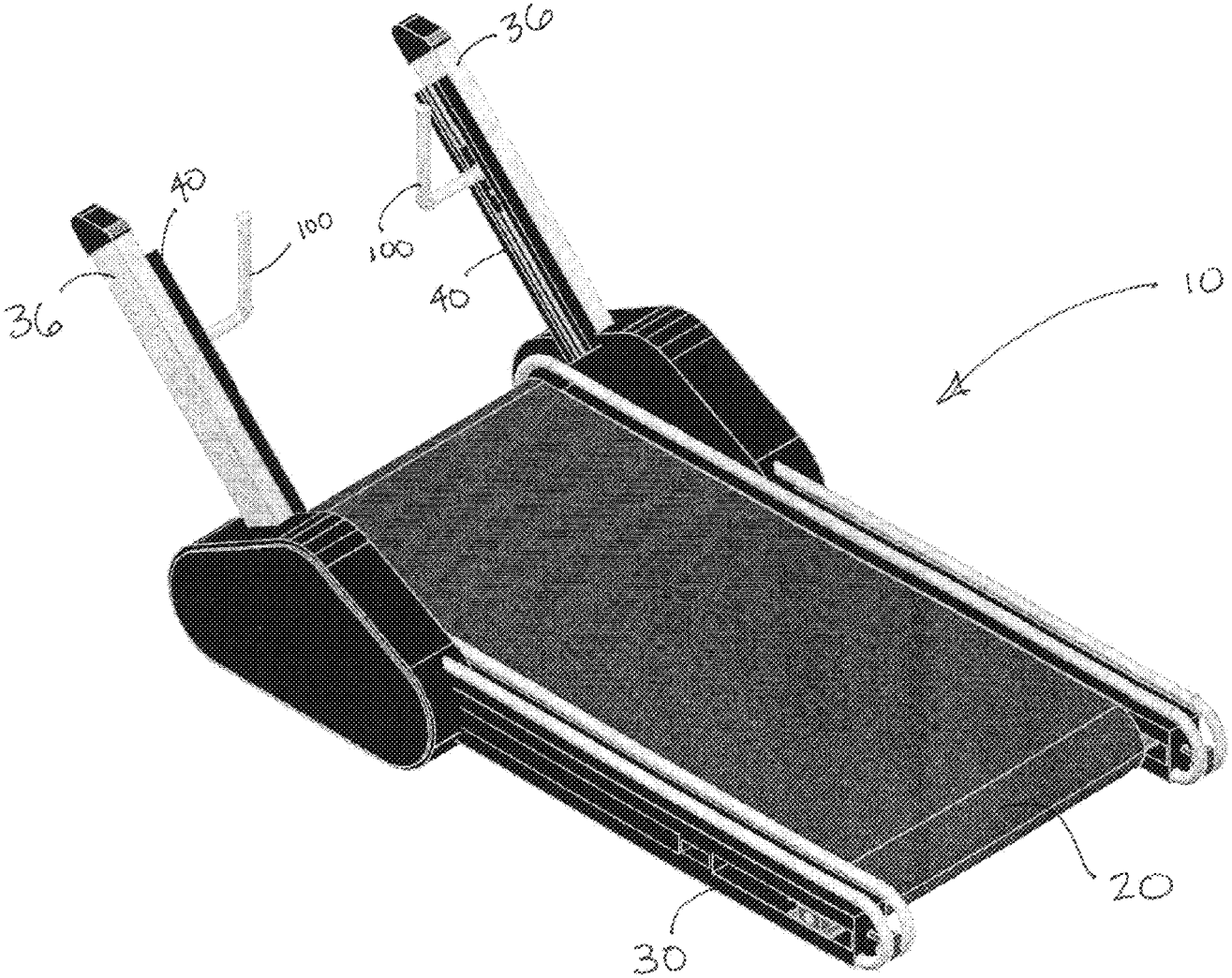
FIG. 1 is a perspective view of a training machine having an endless belt.

Referring now to the figures in general and to FIG. 1 specifically, an endless belt training apparatus is designated generally 10. The apparatus 10 is a multi-function treadmill platform adapted to facilitate a variety of exercises. The treadmill is a non-motorized platform designed to provide high intensity exercises having high inertial loads and is configured to facilitate a variety of sport specific exercises that are commonly done without a treadmill, such as blocking sled exercises and tire pull exercises.

Overview

Figure 2:
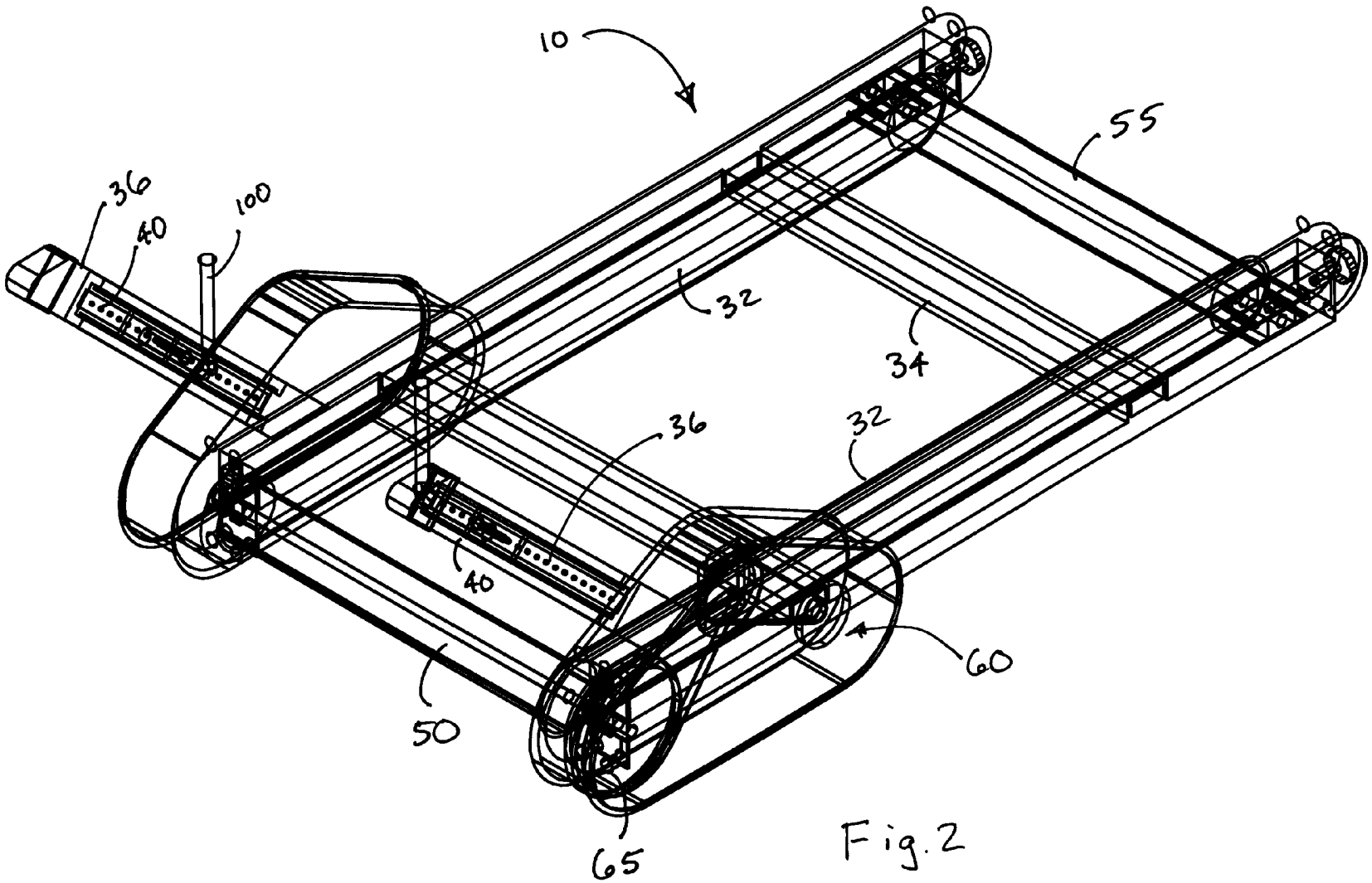
FIG. 2 is a perspective view, partially cut-away of the training machine illustrated in FIG. 1.
Figure 3:
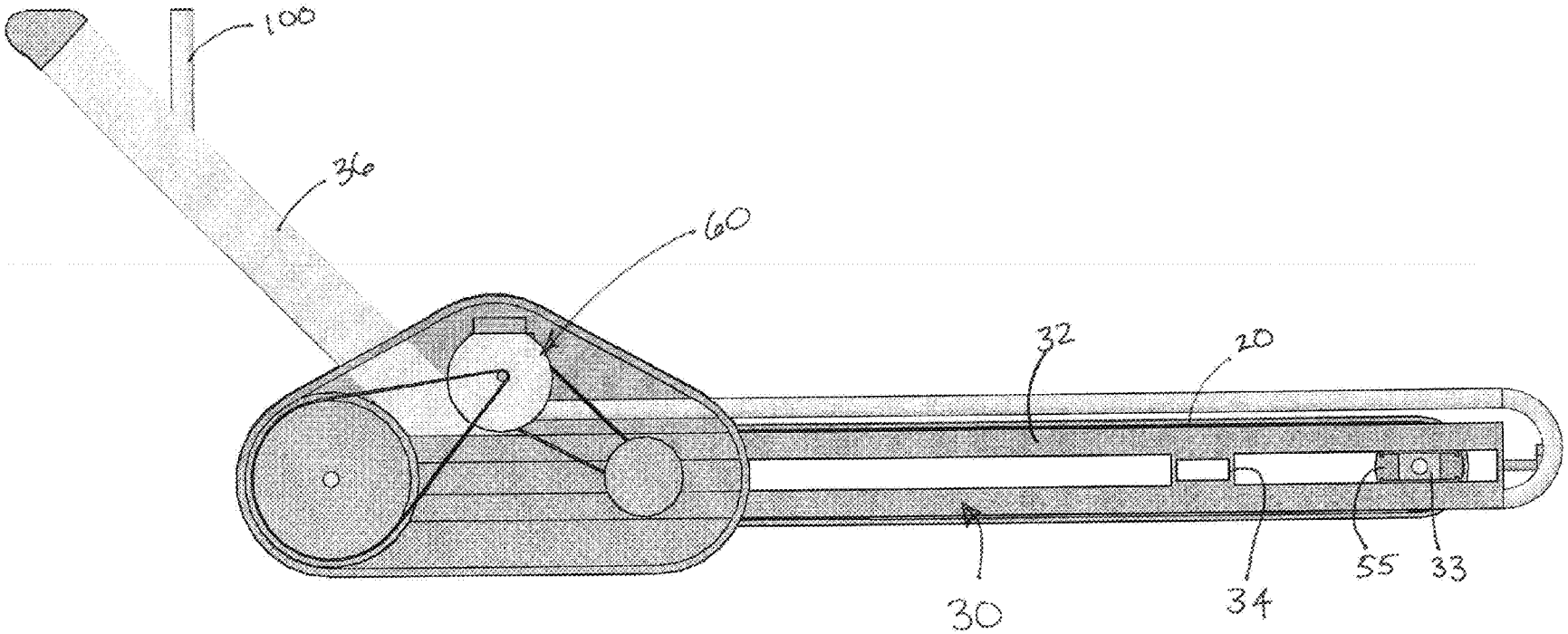
FIG. 3 is a side view of the training machine illustrated in FIG. 2.
Figure 4:
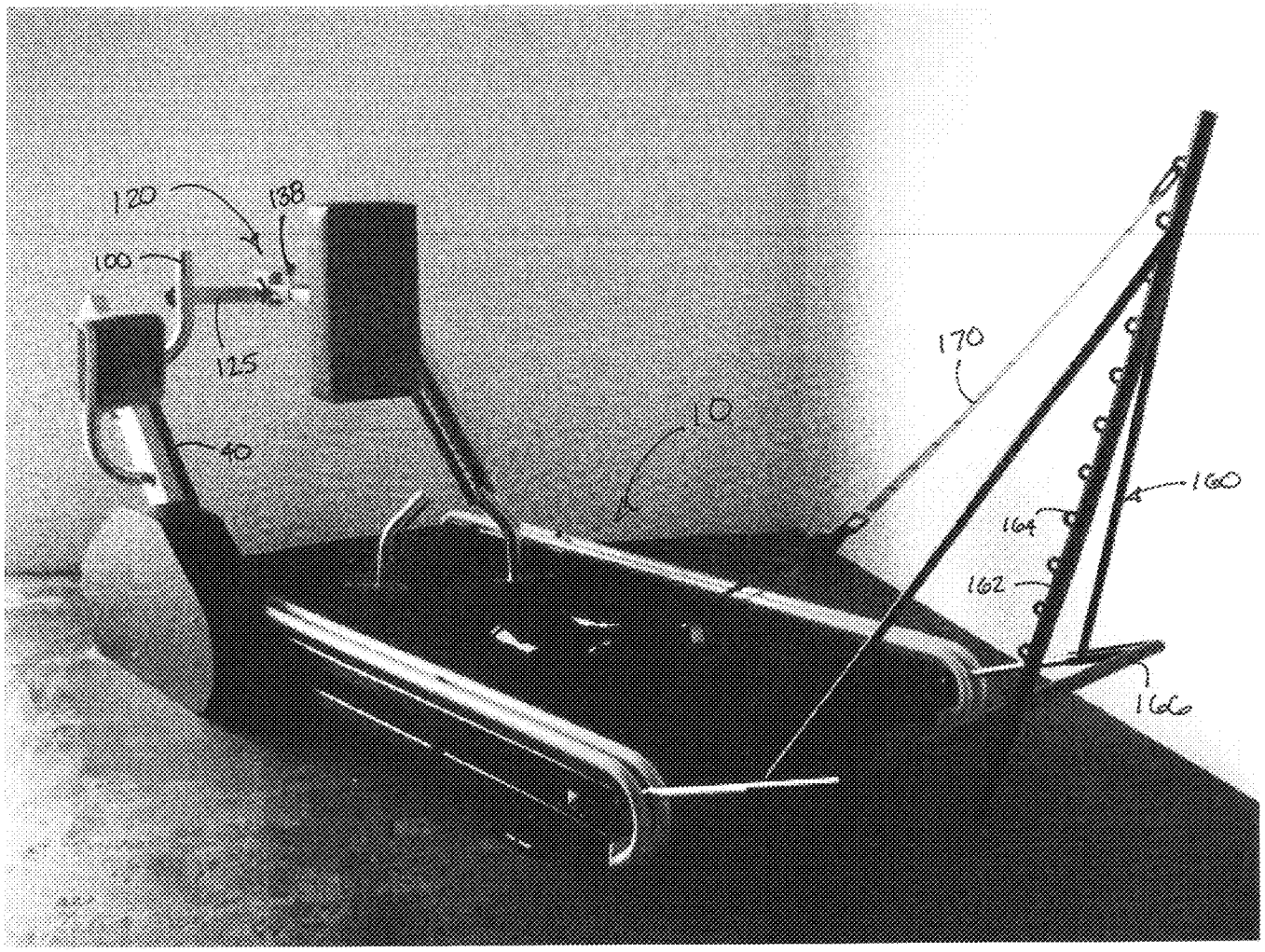
FIG. 4 is a rear perspective view of the training machine illustrated in FIG. 1, illustrated with a rearward mounting frame.

As shown in FIGS. 1-4, the system 10 includes an endless belt 20 that functions as a treadmill. A drive control system 60 controls the operation of the belt 20 to provide high inertial load and continuous resistance during use. The system further includes one or more elements that the user engages during use to facilitate various exercises. For instance, a pair of arms 36 at the forward end of the treadmill provide for attaching handles that the user may engage. As shown in FIG. 4, the system may also include a rearward mounting assembly 160 for attaching straps, harnesses or other items that the user may engage. In this way, the treadmill allows the operator to simulate high intensity pushing or pulling exercises in addition to other conditioning moves.

Platform

Turning now to FIGS. 1-3, the details of the system 10 will be described in greater detail. The treadmill includes a frame 30 having a pair of elongated rails 32 spaced apart from one another. The rails 32 are formed of a high strength, durable rigid material, such as steel or other metal. However, other materials may be used. Referring to FIG. 3, each rail comprises an upper rail 32*a* and a lower rail 32*b*. The upper rail is generally parallel with and separated from the lower rail 32*b* to create a gap. The rails are connected by a plurality of crossbars 34 that rigidly connect the rails 32 to form a rigid platform. In the present instance, the ends of the cross bars 24 extend into the gap between the upper and lower rails 32*a*, 32*b*.

The treadmill belt 20 is entrained about a head roller 50 and a tail roller 55. Referring to FIG. 3, the tail roller 55 is rotatably supported by a pair of support blocks, such as pillow blocks 33. Each pillow block 33 is fixedly connected with the frame in the gap between the upper and lower rails 32*a*, 32*b*. The tail roller 55 rotates about an axle, and each end of the axle is rotatably supported by one of the pillow blocks 33. In this way, the axle for the tail roller 55 rotates freely within the pillow blocks. The head roller 50 is rotatably mounted at the forward end of the frame. As is discussed further below, the head roller 50 is controlled by a drive control system 60.

The frame of the system may further include a pair of support arms 36 projecting upwardly from the forward end of the rails 32. Each arm is rigidly connected with one of the rails 32, projecting upwardly and forwardly at an angle relative to the surface of the belt 20. In the present instance, each arm projects forwardly beyond the head pulley 50 and the forward edge of the belt 20.

Forward Accessory Mount

Each arm 36 may be configured to cooperate with one or more attachments that may assist the user during operation. In the present instance, the arms comprise a track 40 for variably positioning attachments as described further below. The track may be integrally formed with the arm, however, in the present instance, the track is formed of a separate material and rigidly connected with the arm. For instance, the track may be formed of a rigid low-friction material, such as a plastic.

Figure 7:
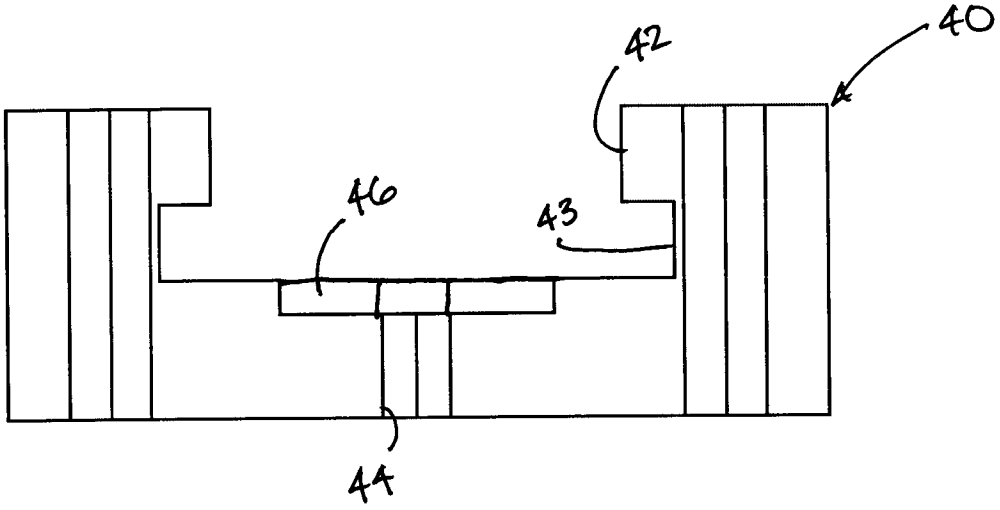
FIG. 7 is an enlarged fragmentary cross-sectional view of a track of the handle positioning system illustrated in FIG. 6.
Figure 8:
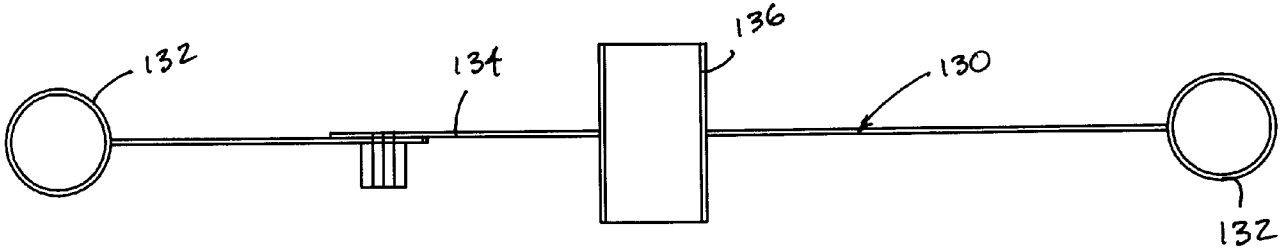
FIG. 8 is a fragmentary top view of a mounting bracket for an accessory for the training machine illustrated in FIG. 1.
Figure 9:
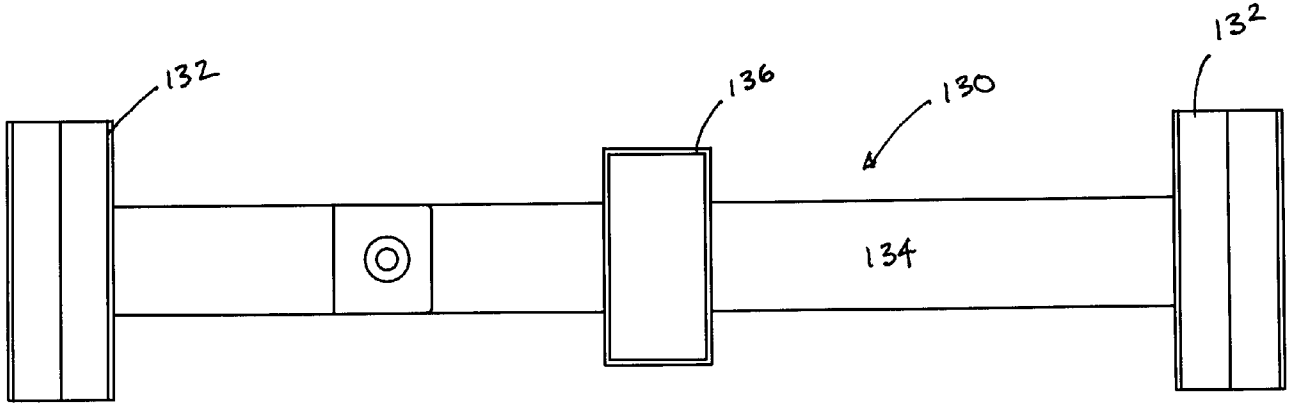
FIG. 9 is a side view of the mounting bracket illustrated in FIG. 8.
Figure 11:
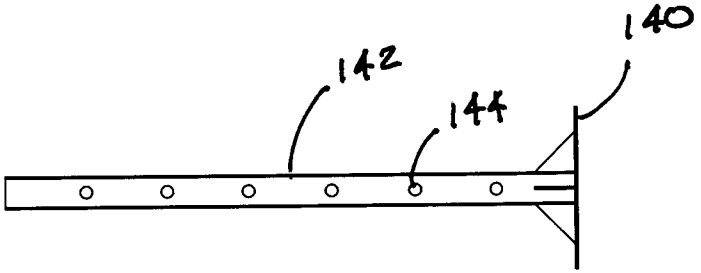
FIG. 11 is a side elevational view of the mount illustrated in FIG. 10.
Figure 10:
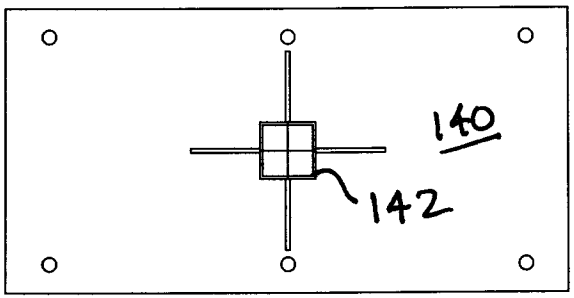
FIG. 10 is a side elevational view of a mount cooperable with the mounting bracket illustrated in FIG. 8.

Referring to FIG. 7, a cross-section of one of the tracks 40 is illustrated. The track 40 may be formed in any of a variety of configurations, however, in the present instance the track is a T-slot configuration. The side walls 42 form a shoulder projecting inwardly toward the opening of the channel, so that the sidewalls form an undercut groove or slot 43.

A series of stop elements are formed in the channel 40 for cooperating with various attachments. The stop elements may be any of a variety of locking elements, such as detents, ratchet teeth, notches or similar element. In the present instance, the stop elements comprise a series of aligned sockets 44 in the base of the channel 40. The sockets may be formed directly into the channel. However, in the present instance, the sockets are formed in an insert 46 that is embedded in the base of the channel 40. The insert 46 is an elongated narrow bar formed of a durable and rigid material, such as steel or aluminum. A series of aligned holes are formed in the insert 46 along the length of the insert. A recess formed in the base of the channel 40 is configured to receive the insert 46 as shown in FIG. 7.

Figure 6:
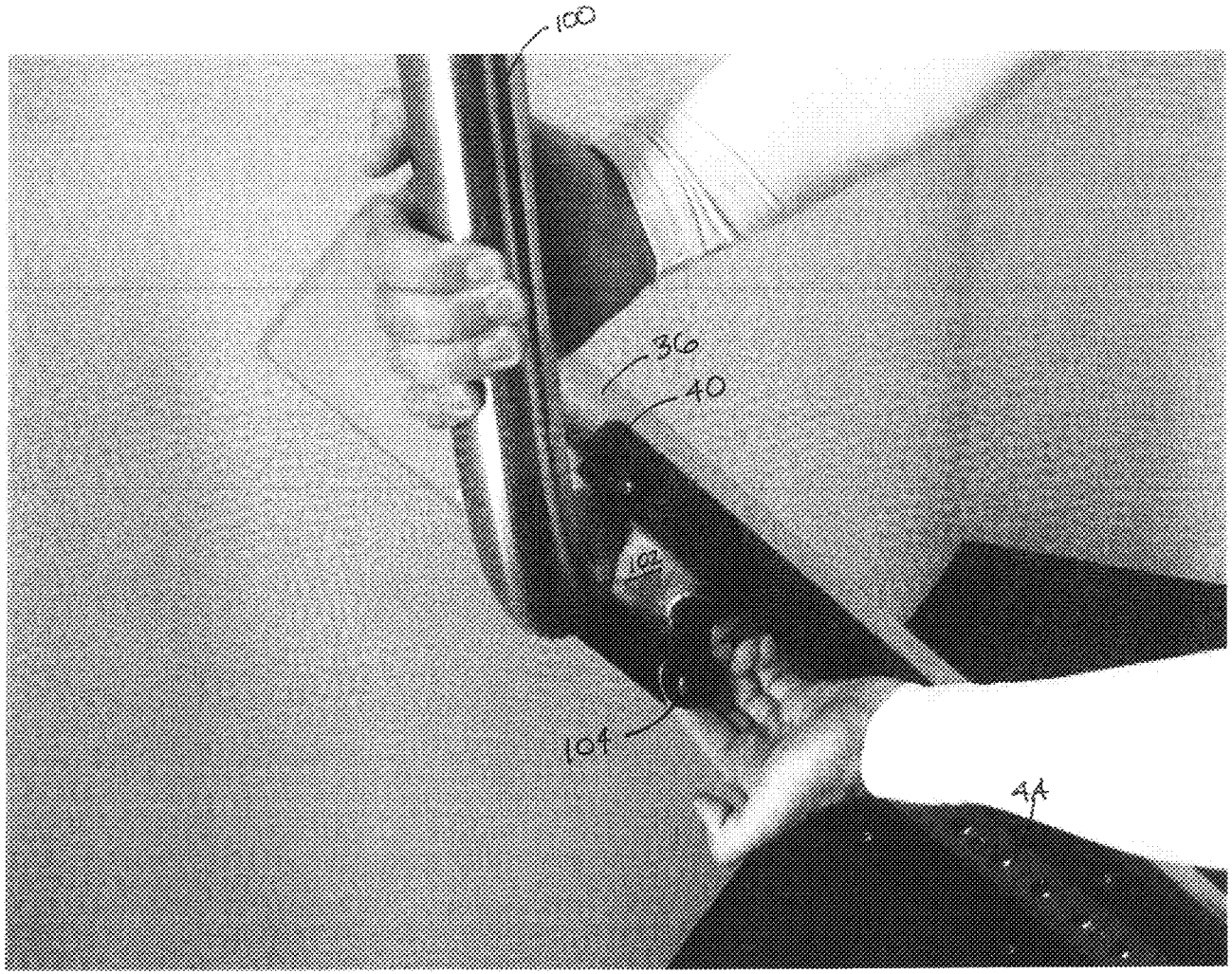
FIG. 6 is an enlarged fragmentary view of a handle positioning system of the training machine illustrated in FIG. 1.

Referring to FIG. 6, one of the accessories that can be mounted onto the forward arms 36 is illustrated. In FIG. 6, the accessory is a handle or hand grip 100. The hand hold comprises a generally L-shaped handle rigidly mounted onto a plate 102 that operates as a sled. The sled 102 is configured to slide in the track so that the handle can be moved vertically. Specifically, in the present instance, the sled is a rectangular plate having a thickness less than the thickness of the undercut slot 43 in the track.

The sled 102 further includes a locking element for locking the sled in position along the length of the track 40. The locking element may comprise any of a variety of friction or mechanical locking or engagement elements. In the present instance, the locking mechanism 104 is a locking pin engageable with the sockets 44 in the track. Specifically, the pin 104 extends through the sled 102 and into a socket in the track 40 to lock the handle 100 in position along the length of the track. The locking pin 104 includes a head that the user may grasp to pull the pin outwardly, away from the track to pull the locking pin out of the socket. Once the locking pin is disengaged from the socket, the sled may be moved along the track 40 to reposition the handle at a different position.

The arms 102 of the handles 100 may be formed in a variety of shapes and configurations. In the present instance, the arms are generally L-shaped having a short leg extending generally horizontally away from the sled, and a longer leg transverse the short leg extending generally vertically. In one embodiment, the long leg extends substantially vertically as illustrated in FIG. 6. Alternatively, the vertical leg may form an angle with a vertical axis, so that the long leg of the handle angles forwardly, away from the user when the user is on the treadmill. For instance, the long leg of the handle may be angled to be substantially parallel with the angle of the track 40 relative to the horizontal axis.

Since the arms 36 are mounted at an angle relative to the treadmill, moving the sled 102 upward along the track moves the handle upwardly and forwardly relative to the head roller 50. When the sled is positioned in the track toward the bottom end of the track, the handle may be positioned at or rearward of the longitudinal position of the head roller. When the sled is positioned toward the upper end of the track, the handle may be positioned forwardly of the longitudinal position of the head roller. In this way, in the forward position, the user will reach out from the forward end of the treadmill to grasp the handles. Such an arrangement facilitates use of the treadmill in a position in which the user's torso is angled forwardly relative to the horizon to drive the treadmill rearwardly to simulate a pushing exercise, similar to pushing a weighted sled or an automobile.

Blocking Pad Assembly

Referring to FIGS. 4 and 8-11 an alternate attachment is illustrated for mounting on the forward arms 36 of the treadmill 10. The alternate attachment is a block pad assembly 120 for use in simulating various training routines in which the user's torso pushes up against a pad similar to a blocking sled. The blocking attachment 120 may mount directly to the arms 36. However, in the present instance, the blocking sled is configured to attach to the hand holds 100.

The blocking sled 120 includes a generally horizontal mounting bracket in the form of a yoke 130. The yoke includes a horizontal bar 134 having collars 132 attached to each end. The collars 132 are configured to mate with the vertical leg of the hand holds 100. Specifically, in the present instance, the collars 132 are generally cylindrical having an inner diameter slightly larger than the outer diameter of the vertical leg of the hand holds. In this way, the collars can slide over the hand holds. The horizontal bar 134 may be a unitary element, however, in the present instance, the horizontal bar is a two-piece element having mating connectors so that the two pieces are releasably connectable with one another.

A horizontally disposed socket 136 is formed along the length of the yoke 130. The socket 136 receives the stem 142 of a blocking pad support 140. In the present instance, the socket 136 is a generally rectangularly shaped socket having an internal cross-section slightly larger than the external rectangular cross-section of the stem 142. In this way, the rectangular cross section of the socket and the stem impede rotation of the stem relative to the socket, which in turn impedes rotation of the blocking pad relative to the yoke 130.

The blocking pad is mounted on a generally vertical pad support in the form of a rectangular plate 140. The stem 142 is an elongated horizontal bar having one end rigidly connected with the vertical pad support. In the present instance, the stem includes a series of spaced apart holes or sockets for releasably connecting the stem with the socket 136. The blocking pad assembly may include any of a variety of frictional or positive locking elements, such as ratchet element. However, in the present instance, the assembly 120 includes a retainer pin releasably connectable with the holes 144 in the stem. In this way, the stem 142 can be inserted into or withdrawn from the socket to variably position the blocking pad along the longitudinal length of the treadmill. Additionally, since the handles 100 can be variably positioned along the arms 36, the vertical position of the blocking pad can be adjusted to suit the user.

Rearward Accessory Mount

In addition to the forward mounted accessories described above, the system 10 may include one or more accessories mounted on the rearward end of the treadmill. Specifically, the system may include a rear auxiliary mount connected with the rearward end of the frame 30, such as the rearward end of the rails 32. The auxiliary mount 160 may be fixidly connected with the frame 30, however, in the present instance, the auxiliary mount is releasable connected with the frame. For example, the auxiliary mount 160 may be threadedly connectable with a threaded stem or threaded socket on the frame 30. Alternatively, the auxiliary mount may include a keyed connector and a keyhole slot or socket may be mounted on the frame. These or a variety of releasable mechanical connections may be implemented for rigidly connecting the auxiliary mount 160 with the frame 30.

The auxiliary mount 160 includes a frame 166 that supports a generally vertical post 162. The vertical post extends upwardly generally perpendicular to the operating surface of the treadmill belt 20. The vertical post 162 includes a connector 164 for attaching optional elements that can increase the variety of exercises available using the system 10. Such optional elements may include an elongated flexible strap or harness, such as the suspension exercise system sold by Fitness Anywhere LLC in San Francisco, Calif. under the trademark "TRX Suspension Trainers".

The connector 164 may be a moveable element so that the point of connection between the optional accessory 170 and the vertical post may vary. For instance, the vertical post may include a vertical track and the connector may include an element that slides within the track to reposition the vertical position of the point at which the accessory 170 connects with the vertical post. However, in the present instance, the vertical post comprises a plurality of attachment elements vertically spaced along the height of the vertical post. Specifically, the connectors 164 may be hoops or eyelets spaced along the length of the vertical post 162. The accessory 170 may include a clip that is releasably connectable with any of the connectors 164 to attach the accessory with the frame. As discussed further below, such accessories facilitate the use of the system to replicate various high-intensity pulling exercises.

Drive System

Figure 5:
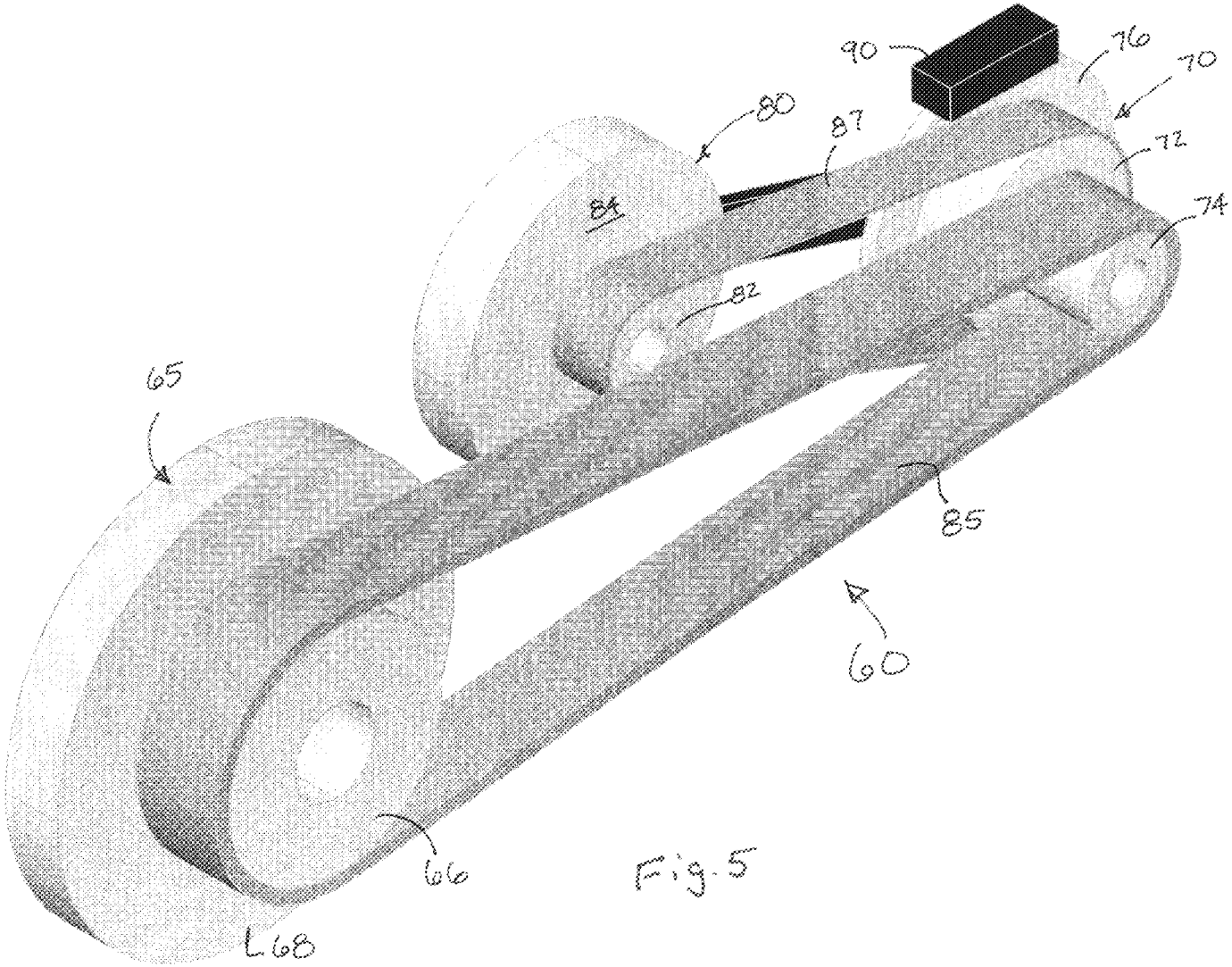
FIG. 5 is an enlarged fragmentary view of a drive system of the training machine illustrated in FIG. 1.

Referring now to FIGS. 2,3 and 5, the details of the drive system will be described in greater detail. In the present instance, the apparatus 10 includes a non-motorized drive system. The treadmill is driven entirely by the force created by the user. Further still, in the present instance, the system includes a drive control 60 for controlling the operation of the belt 20 as the user drives the belt. For instance, the drive control 60 may vary the inertial force required to start the treadmill and to continue driving the treadmill. Although the features of the drive system used in the treadmill are described further below, it should be understand that various features of the system may be deployed independently of the configuration of the drive control and or drive system. For instance, the various attachments and accessories 100, 120, 160 and 170 described above may be used with a treadmill that incorporates a different drive system, such as a drive system using a motor.

As discussed previously, the drive system of the treadmill 10 includes a wide flat belt 20 entrained about a head roller 50 and a tail roller 55. The system does not include a motor to drive the belt around the rollers. A drive control 60 operates to vary the force required to drive the belt. In certain settings, the force required may be quite high. Accordingly, to prevent slippage between the belt and the rollers 50, 55 as the user drives the belt, in the present, the bottom surface of the belt has a relatively high coefficient of friction. For instance, the belt may be constructed so that the lower surface comprises an exposed layer of nylon. In the present instance, the rollers 50, 55 may also include an outer surface having a relatively high coefficient of friction to provide a non-slip engagement surface between the outer surface of the rollers and the bottom surface of the belt. For instance, the rollers may be formed of nylon. Additionally, as described above, the interface between the inner surface of the belt 20 and the deck of the system combines to provide a relatively high friction interface that creates a drag that offsets the tendency of the belt to continue to rotate around the rollers 50, 55 after the user overcomes the inertia of the drive control 60.

The system is designed to provide significant resistance to rotation of the treadmill belt 20. Additionally, the system is designed to provide smooth rotation of the treadmill while requiring the user to continue to drive the belt once the belt is moving. In prior systems, the inertia of the system tended to cause the belt to "run on" after the user overcame the inertial force required to start the belt moving. Therefore, such systems require significantly less force to continue to drive the belt. In contrast, in the present system, the force necessary to continue to drive the belt is similar to the force necessary to start the belt in motion. In this way, the user must continue to apply significant driving force to continue rotation of the belt or the belt will stop.

To provide a high resistance to rotation, the system 10 includes a drive control 60 that includes a primary flywheel 65 connected with the front roller 50. The primary flywheel 65 comprises a central hub 66, which in the present instance is generally cylindrical. A rotary disk 68 attached to the hub 66 is weighted to move weight radially away from the central hub. Specifically, the rotary disk 68 has a greater diameter than the hub 66, thereby increasing the rotational moment of inertia of the flywheel.

The primary flywheel 65 is directly connected to the front roller 50 so that the primary flywheel rotates at the same rate as the front roller. Additionally, rotation of the front roller causes rotation of the primary flywheel, The primary flywheel 65 may be connected to the front roller by any of a variety of power transmission elements, such as belts, chains and/or gears. However in the present instance, the primary flywheel is rigidly connected to the front roller so that the primary flywheel is coaxial with the front roller.

The drive control 60 further includes a secondary flywheel 70 rotationally connected with the primary flywheel 65. The secondary flywheel comprises a major hub 72 and a minor hub 74, wherein the minor hub has a smaller diameter than the diameter of the major hub. A rotary disk 76 attached with the major hub 72 is weighted to move weight radially away from the central axis of the major hub 72. Specifically, the rotary disk 76 has a greater diameter than the major hub, thereby increasing the rotational moment of inertia of the secondary flywheel.

The drive control 60 may also include a tertiary flywheel 80. The tertiary flywheel comprises a central hub 82 and a rotary disk 84 connected to the hub to increase the rotational moment of inertia similar to the primary flywheel 65.

The flywheels 65, 70, 80 of the drive control 60 may be formed of any of a variety of materials, although, preferably the flywheels are formed of a dense material. In the present instance, the flywheels are formed of metal, such as steel.

The drive system is illustrated in FIGS. 3 & 5. It should be noted that the variation between the layout of the flywheels in FIG. 3 and FIG. 5 illustrate that the arrangement of the flywheels can be varied even when the interconnections between the flywheels remains the same. Similarly, the interconnections between the flywheels can be varied. It is noted that the interconnections and arrangement of the flywheels shown in FIG. 3 is used in the present instance. The flywheels of the drive control 60 are rotationally connected. In the present instance, the primary flywheel is connected to the secondary flywheel 70 and the secondary flywheel is connected to the tertiary flywheel 80. A variety of elements can be used to rotationally connect the flywheels, such as chains, gears and/or belts. However, in the present instance, the flywheels are interconnected by drive belts. Specifically, a primary drive belt 85 is entrained about the hub 66 of the primary flywheel 65 and the minor hub 84 of the secondary flywheel 70. A second drive belt 87 is entrained about the major hub 72 of the secondary flywheel and the hub 82 of the tertiary flywheel 80. In this way, rotation of the primary flywheel 65 drives the secondary flywheel 70, which in turn drives the tertiary flywheel 80.

As shown in FIG. 5, in the present instance, the primary flywheel 65 has a greater rotational moment of inertia than the secondary flywheel 70 as well as the tertiary flywheel 80. Additionally, in the present instance, the connection between the secondary flywheel and the primary flywheel causes the secondary flywheel to rotate at a different speed than the primary flywheel. For instance, in the present instance, the hub 66 of the primary flywheel has a greater diameter than the minor hub 74 of the secondary flywheel. Therefore, the drive belt 85 drives the secondary flywheel 75 so that the secondary flywheel has a greater angular velocity than the primary flywheel. For example, in the present instance, the spin ration of the primary flywheel to the secondary flywheel is 15:1, so that the secondary flywheel rotates 15 times faster than the primary flywheel 65. Similarly, the major hub 72 of the secondary flywheel 70 has a greater diameter than the hub 82 of the tertiary flywheel 80 so that the tertiary flywheel has a greater angular velocity than the secondary flywheel. For example, in the present instance, the spin ratio of the secondary flywheel to the tertiary flywheel is 3:1, so that the tertiary flywheel 80 rotates three times faster that the secondary flywheel 65 so that the tertiary flywheel rotates 45 times faster than the primary flywheel 65. By utilizing multiple flywheels, the drive system 60 controls the rotation of the belt 20 to provide smooth rotation of the belt without significant lag between the user's strides that can be jarring to the user. However, it should be understood that many of the benefits of the system 10 may be recognized if the number of flywheels is changed or even if the flywheels are eliminated.

As described above, the flywheel(s) in the system increase the torque required to drive the belt. Specifically, the user must apply a greater force to the belt to get the belt moving than would otherwise be necessary without the flywheels. However, once the user drives the belt up to a certain speed, the stored energy in the flywheel will tend to drive the belt forwardly even in the absence of the user driving the belt. This is referred to as "run-on". The run-on makes it significantly easier for the user to drive the system at a certain speed once the user accelerates the belt to the desired speed. Therefore, the drive control 60 may include a mechanism for controlling the run-on effect of the system.

In the present instance, the drive control 60 includes a brake 90 for limiting the run-on effect of the system and/or controlling the resistance of the system. The brake may be any of a variety of electrical or mechanical braking systems. Although the brake may be a fixed resistance braking system, in the present instance, the brake provides a variable resistance. For instance, the brake 90 may be an electromagnetic brake that may be controlled by the user to vary the resistance applied by the brake. The brake may apply braking force directly to any of a variety of the elements in the drive system, including the rollers, the belt or the flywheels. However, in the present instance, the brake applies a braking force to one of the flywheels. Specifically, in the present instance, the brake 90 straddles the outer rim of the rotary disk 72 of the secondary flywheel. In this way, actuating the brake 90 applies a braking force to secondary flywheel 70.

As described above, the electromagnetic brake 90 may be controlled by the user to vary the braking force applied to the drive system. In the present instance, a controller controls activation of the brake 90 in response to user input. A user input mechanism such as a touch screen display 25 may be incorporated to allow the user to input various information. Based on the information input by the user, a controller controls the brake to apply the appropriate braking force to the second flywheel 70.

In addition to providing a mechanism for inputting information to control the system, the touch screen 25 may provide feedback to the user regarding the level of exertion, time, distance etc. For example, the display may display information regarding the power generated by the user during operation. For instance, the display may graph a power curve illustrating the watts generated during use versus time. The power curve may be generated automatically by the system based on various parameters, such as the amount of braking applied and the rotational rate of one or more of the pulleys as measured by one or more sensors for measuring the rotational rate of one or more of the pulleys. Additionally, the system may calculate the power generated by the user during use based on various characteristics input by the user, such as user age, sex and weights. The user may vary the input based on the feedback displayed on the screen, to thereby vary the settings for the system.

Configured as described above, the system 10 is operable to provide a plurality of high intensity training exercises. For instance, the user may operate the system to simulate a driving or pushing exercise. The user may position the hand holds 100 at the appropriate height and input information to set the desired resistance level. The flywheels 65, 70 and 80 significantly increase the inertia required to start driving the belt, the user imparts significant force to start rotation of the belt. To apply significant force, the user leans substantially forwardly so that the user's torso may form an acute angle with the belt. An upright treading motion may not provide sufficient rearward drive to the belt to move the belt rearwardly, so that the user would simply walk off the front of the device. The hand holds 100 are configured to support a user while the user is leaned substantially forwardly so that the user can impart a greater rearward driving force onto the belt. In this way, the hand holds 100 provide a stable surface for the user to push against as the user drives against the belt to overcome the inertia of the drive control 60. Similarly, as described above, the blocking pad assembly 120 may be mounted onto the track 40 of the arms 36. The user can drive his or her shoulder against the blocking pad to simulate driving a blocking sled or other blocking device. The blocking pad assembly 120 operates as a stable surface for the user to push against to provide sufficient counter-force to the force necessary to drive the belt rearwardly.

The system may also be used to simulate pulling exercises. For instance, the user may grasp a strap 170 attached to the rear auxiliary mount 160 and drive rearwardly against the belt 20 while pulling on the strap. Additionally, the user may lean substantially forwardly away from the auxiliary mount 160 to provide a more horizontal angle between the user and the belt as the user drives the belt rearwardly. In such an exercise, the user may face rearwardly toward the rear auxiliary mount 160 so that the user simulates rearward striding as if the user is walking backward. Alternatively, the user may face sideward (i.e. toward one of the side rails 32) to simulate a sidestepping stride while pulling against the strap.

In yet another alternative, the user may wear a harness that is attached to the rearward auxiliary mount 160 by a flexible connector such as a strap or leash. Facing forwardly, the user pulls against the leash while driving the belt rearwardly. In such an arrangement, the user leans forwardly, away from the rearward auxiliary mount 160. Additionally, the user may reach down to perform a bear crawl, crawling on hands and feet to drive the belt.

As can be seen from the foregoing, the system 10 provides a platform for performing a variety of high intensity exercises. In particular, the system can be used to simulate a variety of high intensity pushing and/or pulling exercises. The system allows the user to vary the intensity level to accommodate various fitness levels of various users and to accommodate various training regimes. Additionally, the high inertial force required to drive the system, combined with the use of multiple flywheel drive controls provides high intensity training while smoothing out the motion of the treadmill despite the intermittent driving action of the user.

It will be recognized by those skilled in the art that changes or modifications may be made to the above-described embodiments without departing from the broad inventive concepts of the invention. It should therefore be understood that this invention is not limited to the particular embodiments described herein, but is intended to include all changes and modifications that are within the scope and spirit of the invention as set forth in the claims.

The invention claimed is:

1. A training apparatus, comprising:

an endless non-motorized belt having an upper surface upon which a user can walk, wherein the belt is entrained between a first rotatable element and a second rotatable element and wherein the first rotatable element and the second rotatable element are rotatably connected with a frame;

a first flywheel connected with the first rotatable element such that rotation of the first rotatable element rotates the first flywheel, wherein the flywheel has a greater moment of inertia that the first rotatable element;

a second flywheel rotationally connected with the first flywheel such that rotation of the first flywheel rotates the second flywheel, wherein the second flywheel has a different moment of inertia than the first flywheel and rotates at a different speed than the first flywheel;

a pair of opposing tracks positioned adjacent the first rotatable element for variably positioning a forward accessory, wherein the pair of tracks are rigidly connected with the frame so that the tracks do not move relative to the frame when the belt is rotated; and a pair of handles to be grasped by the user, wherein the handles are mounted on the tracks so that the vertical position of the handles can be varied by moving the handles on the track.

2. The apparatus of claim 1 wherein the first and second rotatable elements are rollers, pulleys or wheels.

3. The apparatus of claim 1 wherein the second flywheel has a smaller moment of inertia than the first flywheel.

4. The apparatus of claim 3 comprising a third flywheel rotationally connected with the second flywheel such that rotation of the second flywheel rotates the third flywheel, wherein the third flywheel rotates at a different speed than the second flywheel.

5. The apparatus of claim 1 wherein the belt has an inner surface having a high-friction surface for engaging the first and second rotatable elements.

6. The apparatus of claim 1 comprising a brake for applying a variable braking force to the first or second flywheel, wherein the brake is selectively controllable.

7. The apparatus of claim 6 comprising a controller for controlling the braking force at a predetermined level in response to input from the user.

8. The apparatus of claim 1 comprising a vertical post mounted adjacent the second rotatable element, wherein the vertical post comprises a connector for connecting a rearward accessory to the vertical post.

9. The apparatus of claim 8 wherein the rearward accessory comprises an elongated flexible strap.

10. The apparatus of claim 8 wherein the connector is configured to vary the vertical position of the point at which the rearward accessory is attached to the vertical post.

11. The apparatus of claim 8 wherein the connector comprises a plurality of connection elements vertically spaced apart from one another, wherein the rearward accessory is releasably connectable with each of the connection elements so that the vertical connection position of the rearward accessory can be varies by varying the connection element to which the rearward element is connected.

12. The apparatus of claim 8 wherein the connector comprises a vertically moveable element so that the vertical position of the connector can be variably set.

13. The apparatus of claim 1 wherein the first flywheel rotates at the same speed as the first rotatable element.

14. The apparatus of claim 1 wherein the first flywheel comprises a rotatable hub connected with a weighted disc having a larger diameter that the rotatable hub.

15. A training apparatus, comprising:

an endless belt having an upper surface upon which a user can walk, wherein the belt is entrained between a first rotatable element and a second rotatable element;

a forward accessory mount comprising:

a pair of arms projecting upwardly relative to the endless belt, wherein the arms are angled forwardly relative to the direction of rotation of the belt, wherein the arms remain in a fixed forward position during use of the endless belt;

a pair of hand holds wherein each hand hold is variably positioned along the length of one of the arms to vary the vertical and horizontal position of the hand holds relative to the belt;

a retainer for each hand hold, wherein the retainer releasably positions the hand holds at a vertical position.

16. The training apparatus of claim 15 wherein the arms extend forwardly beyond the first rotatable element so that the arms project beyond the forward end of the belt.

17. The apparatus of claim 15 wherein each retainer is operable to retain one of the hand holds in position wherein the hand hold is forward of the forward end of the belt.

18. The apparatus of claim 15 comprising:

a brake for applying a braking force to the first or second rotatable element wherein the brake is variable; and a controller for controlling the braking force at a predetermined level in response to input from the user.

19. The apparatus of claim 15 comprising a vertical post mounted adjacent the second rotatable element midway across a width of the second rotatable element, wherein the vertical post comprises a connector for connecting a rearward accessory to the vertical post.

20. The apparatus of claim 19 wherein the rearward accessory comprises an elongated flexible strap.

21. The apparatus of claim 19 wherein the connector is configured to vary the vertical position of the point at which the rearward accessory is attached to the vertical post.

22. The apparatus of claim 19 wherein the connector comprises a plurality of connection elements vertically spaced apart from one another, wherein the rearward accessory is releasably connectable with each of the connection elements so that the vertical connection position of the rearward accessory can be varies by varying the connection element to which the rearward element is connected.

23. A training apparatus, comprising:

an endless non-motorized belt having an upper surface upon which a user can walk, wherein the belt is entrained between a first rotatable element and a second rotatable element;

a first flywheel connected with the first rotatable element such that rotation of the first rotatable element rotates the first flywheel, wherein the flywheel has a greater moment of inertia that the first rotatable element;

a second flywheel rotationally connected with the first flywheel such that rotation of the first flywheel rotates the second flywheel, wherein the second flywheel rotates at a different speed than the first flywheel; and a third flywheel rotationally connected with the second flywheel such that rotation of the second flywheel rotates the third flywheel, wherein the third flywheel rotates at a different speed than the second flywheel.

24. The apparatus of claim 23 wherein the second flywheel has a different moment of inertia than the first flywheel.

25. The apparatus of claim 23 comprising a brake for applying a variable braking force to the second or third flywheel.

26. The apparatus of claim 25 comprising a controller for controlling the braking force at a predetermined level in response to input from the user.

27. The apparatus of claim 25 wherein the second flywheel has a smaller moment of inertia than the first flywheel.

28. A training apparatus, comprising:

an endless non-motorized belt having an upper surface upon which a user can walk, wherein the belt is entrained between a first rotatable element and a second rotatable element;

a first flywheel connected with the first rotatable element such that rotation of the first rotatable element rotates the first flywheel, wherein the flywheel has a greater moment of inertia that the first rotatable element;

a second flywheel rotationally connected with the first flywheel such that rotation of the first flywheel rotates the second flywheel, wherein the second flywheel rotates at a different speed than the first flywheel;

a frame rotatably connected with the first and second rotatable elements;

a pair of tracks rigidly connected the frame;

a pair of handles to be grasped by the user, wherein the handles are mounted on tracks so that the vertical position of the handles can be varied by moving the handles on the track;

wherein the tracks and the handles are maintained in a fixed position during use of the apparatus.

29. The apparatus of claim 28 comprising a brake for applying a braking force to the first or second flywheel, wherein the brake is variable.

30. The apparatus of claim 29 comprising a controller for controlling the braking force at a predetermined level in response to input from the user.

31. The apparatus of claim 28 comprising a releasable locking mechanism operable to releasably lock the each of the handles in a fixed position along the respective track.

32. The apparatus of claim 31 wherein tracks extend upwardly and forwardly away from the first rotatable element.

33. The apparatus of claim 28 wherein the second flywheel has a smaller moment of inertia than the first flywheel.

34. A training apparatus, comprising:

an endless non-motorized belt having an upper surface upon which a user can walk, wherein the belt is entrained between a first rotatable element and a second rotatable element;

a first flywheel connected with the first rotatable element such that rotation of the first rotatable element rotates the first flywheel, wherein the flywheel has a greater moment of inertia that the first rotatable element;

a second flywheel rotationally connected with the first flywheel such that rotation of the first flywheel rotates the second flywheel, wherein the second flywheel rotates at a different speed than the first flywheel; and a brake operable to apply a braking force to the second flywheel to increase the force required to drive the non-motorized belt, wherein the brake is variable.

35. The apparatus of claim 29 comprising a controller for controlling the braking force at a predetermined level in response to input from the user.

36. The apparatus of claim 28 wherein the second flywheel has a smaller moment of inertia than the first flywheel.

* * * * *